US010871087B2

(12) United States Patent
Uckermark

(10) Patent No.: US 10,871,087 B2
(45) Date of Patent: Dec. 22, 2020

(54) SWITCHABLE ROCKER ARM

(71) Applicant: DELPHI TECHNOLOGIES IP LIMITED, St. Michael (BB)

(72) Inventor: Chad E. Uckermark, Warwick, NY (US)

(73) Assignee: DELPHI TECHNOLOGIES IP LIMITED

( * ) Notice: Subject to any disclaimer, the term of this patent is extended or adjusted under 35 U.S.C. 154(b) by 0 days.

(21) Appl. No.: 16/260,833

(22) Filed: Jan. 29, 2019

(65) Prior Publication Data

US 2020/0240296 A1 Jul. 30, 2020

(51) Int. Cl.
*F01L 1/18* (2006.01)
*F01L 13/00* (2006.01)

(52) U.S. Cl.
CPC ..... *F01L 1/185* (2013.01); *F01L 13/0005* (2013.01); *F01L 2001/186* (2013.01)

(58) Field of Classification Search
CPC .... F01L 1/18; F01L 2001/186; F01L 13/0005
USPC ..... 123/90.39, 90.44
See application file for complete search history.

(56) References Cited

U.S. PATENT DOCUMENTS 6,467,445 B1 10/2002 Harris
6,604,498 B2 8/2003 Fernandez et al.
6,668,779 B2 12/2003 Hendriksma et al.
6,925,978 B1 * 8/2005 Gerzseny ..... F01L 1/185 123/90.39
7,305,951 B2 12/2007 Fernandez et al.
7,600,498 B2 * 10/2009 Diggs ..... F01L 1/18 123/90.16
7,677,213 B2 3/2010 Deierlein
7,798,113 B2 * 9/2010 Fischer ..... F01L 13/0036 123/90.44
7,882,814 B2 2/2011 Spath et al.
7,926,455 B2 4/2011 Manther et al.
2001/0035140 A1 11/2001 Fernandez et al.
2001/0045197 A1 11/2001 Fernandez et al.
2004/0103869 A1 * 6/2004 Harris ..... F01L 1/08 123/90.16
2005/0132989 A1 * 6/2005 Hendriksma ..... F01L 1/18 123/90.16
2006/0249110 A1 * 11/2006 Fernandez ..... F01L 13/0036 123/90.16

(Continued)

*Primary Examiner* — Patrick Hamo
*Assistant Examiner* — Kelsey L Stanek
(74) *Attorney, Agent, or Firm* — Joshua M. Haines

(57) ABSTRACT

A rocker arm includes a body having a first wall and a second with a central opening provided therebetween, the first wall having a first aperture extending therethrough and the second wall having a second aperture extending therethrough. An inner follower within the central opening selectively reciprocates along a reciprocation axis relative to the body, the inner follower extends through the first aperture and the second aperture. A lost motion spring biases the inner follower to move relative to the body along the reciprocation axis in a first direction. A lock member is moveable along a lock member axis between a coupled position which prevents the inner follower from moving past a predetermined position in a second direction which is opposite of the first direction and a decoupled position which permits the inner follower to move past the predetermined position in the second direction.

17 Claims, 10 Drawing Sheets

(56) References Cited

U.S. PATENT DOCUMENTS

| | | | | |
|---|---|---|---|---|
| 2012/0037107 | A1* | 2/2012 | Church | F01L 13/0005 123/90.41 |
| 2012/0266835 | A1* | 10/2012 | Harman | F01L 1/185 123/90.39 |
| 2014/0290608 | A1* | 10/2014 | Radulescu | F01L 1/18 123/90.39 |
| 2018/0023425 | A1* | 1/2018 | Ahmed | F01L 13/0005 74/527 |

* cited by examiner

SWITCHABLE ROCKER ARM

TECHNICAL FIELD OF INVENTION

The present invention relates to a rocker arm for valve train of an internal combustion engine; more particularly to a rocker arm with an inner follower which selectively reciprocates within a body, and even more particularly to such a rocker arm which includes a lock member for selectively preventing the inner follower from reciprocating relative to the body.

BACKGROUND OF INVENTION

Variable valve activation mechanisms for internal combustion engines are well known. It is known to lower the lift, or even to provide no lift at all, of one or more valves of an internal combustion engine, during periods of light engine load. Such valve deactivation or valve lift switching can substantially improve fuel efficiency of the internal combustion engine.

A rocker arm acts between a rotating eccentric camshaft lobe and a pivot point on the internal combustion engine, such as a hydraulic lash adjuster, to open and close an engine valve. Switchable rocker arms may be a "deactivation" type or a "two-step" type. The term switchable deactivation rocker arm, as used herein, means the switchable rocker arm is capable of switching from a valve lift mode to a no lift mode. The term switchable two-step rocker arm, as used herein, means the switchable rocker arm is capable of switching from a first valve lift mode to a second valve lift mode, that is greater than no lift. It should be noted that the second valve lift mode may provide one or both of increased lift magnitude and increased lift duration or one or both of decreased lift magnitude and decreased lift duration of the engine valve compared to the first valve lift mode. When the term "switchable rocker arm" is used herein, by itself, it includes both types.

A typical switchable rocker arm includes an outer arm and an inner arm where the inner arm includes an inner arm follower which follows a first profile of a camshaft of the internal combustion engine and where the outer arm may include a pair of outer arm followers which follow respective second and third profiles of the camshaft. The follower of the inner arm and the followers of the outer arm may be either sliding surfaces or rollers and combinations thereof. The inner arm is movably connected to the outer arm and can be switched from a coupled state wherein the inner arm is immobilized relative to the outer arm, to a decoupled state wherein the inner arm can move relative to the outer arm. Typically, the outer arm of the switchable rocker arm is pivotally supported at a first end by the hydraulic lash adjuster which fits into a socket of the outer arm. A second end of the outer arm operates against an associated engine valve for opening and closing the valve by the rotation of an associated eccentric cam lobe acting on the follower of the inner arm. The inner arm is connected to the outer arm for pivotal movement about the outer arm's second end with the follower of the inner arm disposed between the first and second ends of the outer arm. Switching between the coupled state and the decoupled state is accomplished through a lock pin which is slidingly positioned in a lock pin bore of the outer arm. One end of the lock pin is moved into and out of engagement with the inner arm. Consequently, when the lock pin is engaged with the inner arm, the coupled state is achieved. Conversely, when the lock pin is not engaged with the inner arm, the decoupled state is achieved.

As shown in U.S. Pat. No. 7,305,951 to Fernandez et al., the disclosure of which is hereby incorporated by reference in its entirety, the other end of the lock pin acts as a piston upon which pressurized oil is applied and vented to affect the position of the lock pin. Also as shown by Fernandez et al., oil is supplied to the lock pin via an oil supply bore which originates in the socket and breaks into the lock pin bore. Other known switchable rocker arms are disclosed in U.S. Pat. No. 7,677,213 to Deierlein and U.S. Pat. No. 7,926,455 to Manther et al.

Another switchable rocker arm is shown in United States Patent Application Publication No. US 2005/0132989 A1 to Hendricksma et al., the disclosure of which is hereby incorporated by reference in its entirety. Unlike the previously mentioned examples where an inner arm selectively pivots relative to an outer arm, Hendricksma discloses an inner follower which selectively reciprocates along a linear path which may be desirable in some applications. While Hendricksma et al. may be effective, alternatives and variations are continually sought in any art.

SUMMARY OF THE INVENTION

Briefly described, and in accordance with the present invention, a rocker arm for transmitting rotational motion from a camshaft to opening and closing motion of a combustion valve in an internal combustion engine includes a body having a first wall and a second wall spaced laterally from the first wall such than a central opening is provided between the first wall and the second wall, the first wall having a first wall aperture extending therethrough along an axis and the second wall having a second wall aperture extending therethrough along the axis; an inner follower which selectively reciprocates along a reciprocation axis relative to the body, the inner follower being located within the central opening and being configured to follow a lobe of the camshaft, the inner follower having an inner follower first portion which extends through the first wall aperture and also having an inner follower second portion which extends through the second wall aperture; a lost motion spring which biases the inner follower to move relative to the body along the reciprocation axis in a first direction; and a lock member moveable along a lock member axis between 1) a coupled position in which the lock member engages the inner follower first portion and the inner follower second portion, thereby preventing the inner follower from moving relative to the body along the reciprocation axis past a predetermined position of the inner follower relative to the body in a second direction which is opposite of the first direction and 2) a decoupled position in which the lock member permits the inner follower to move relative to the body along the reciprocation axis past the predetermined position in the second direction.

The rocker arm described herein allows for linear reciprocation of the inner follower while providing compactness and ease of assembly as will be more readily apparent from a thorough reading of the following description.

BRIEF DESCRIPTION OF DRAWINGS

This invention will be further described with reference to the accompanying drawings in which.

DETAILED DESCRIPTION OF INVENTION

Figure 1:
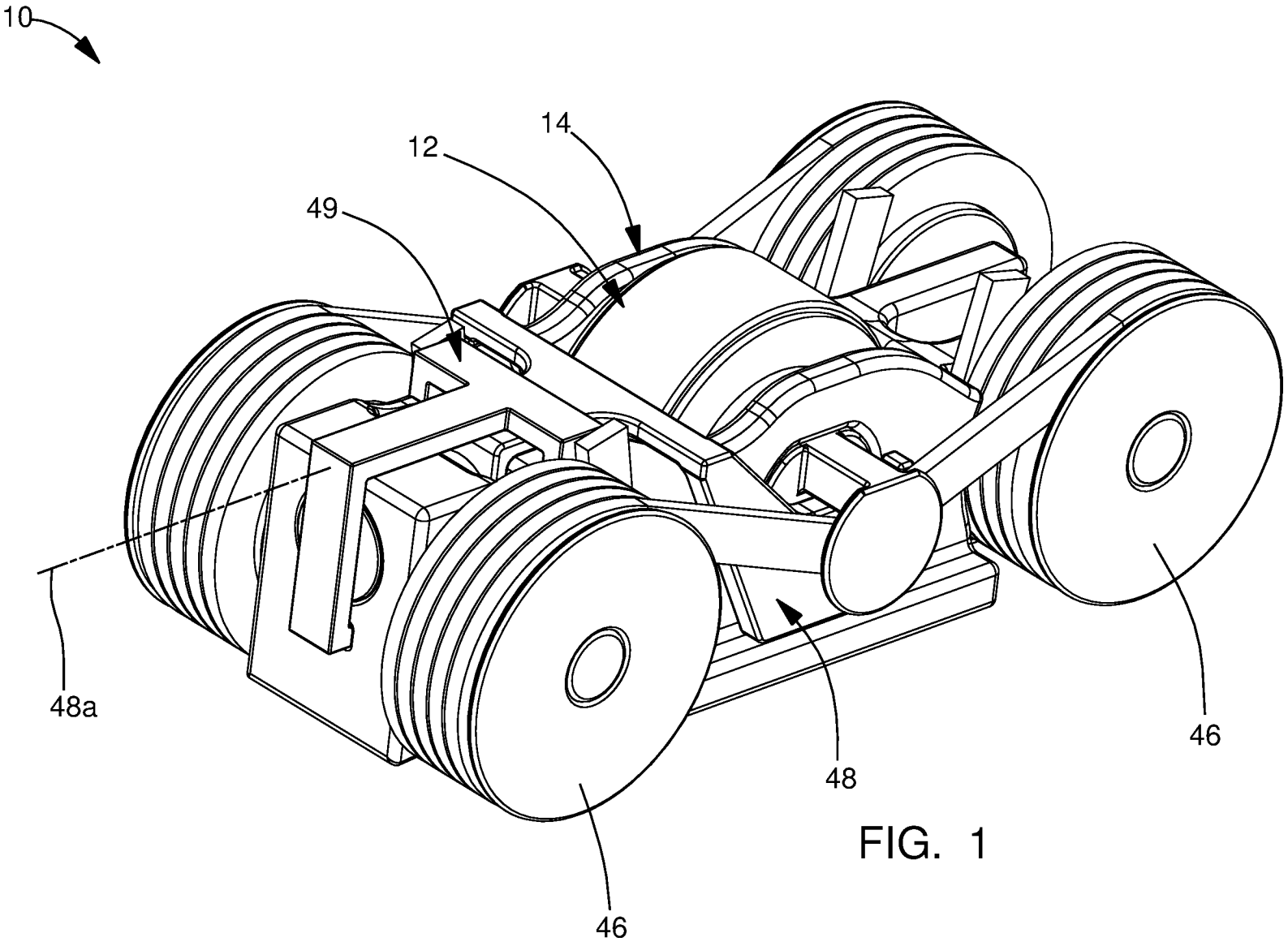
FIG. 1 is an isometric view of a rocker arm in accordance with the present invention.
Figure 2:
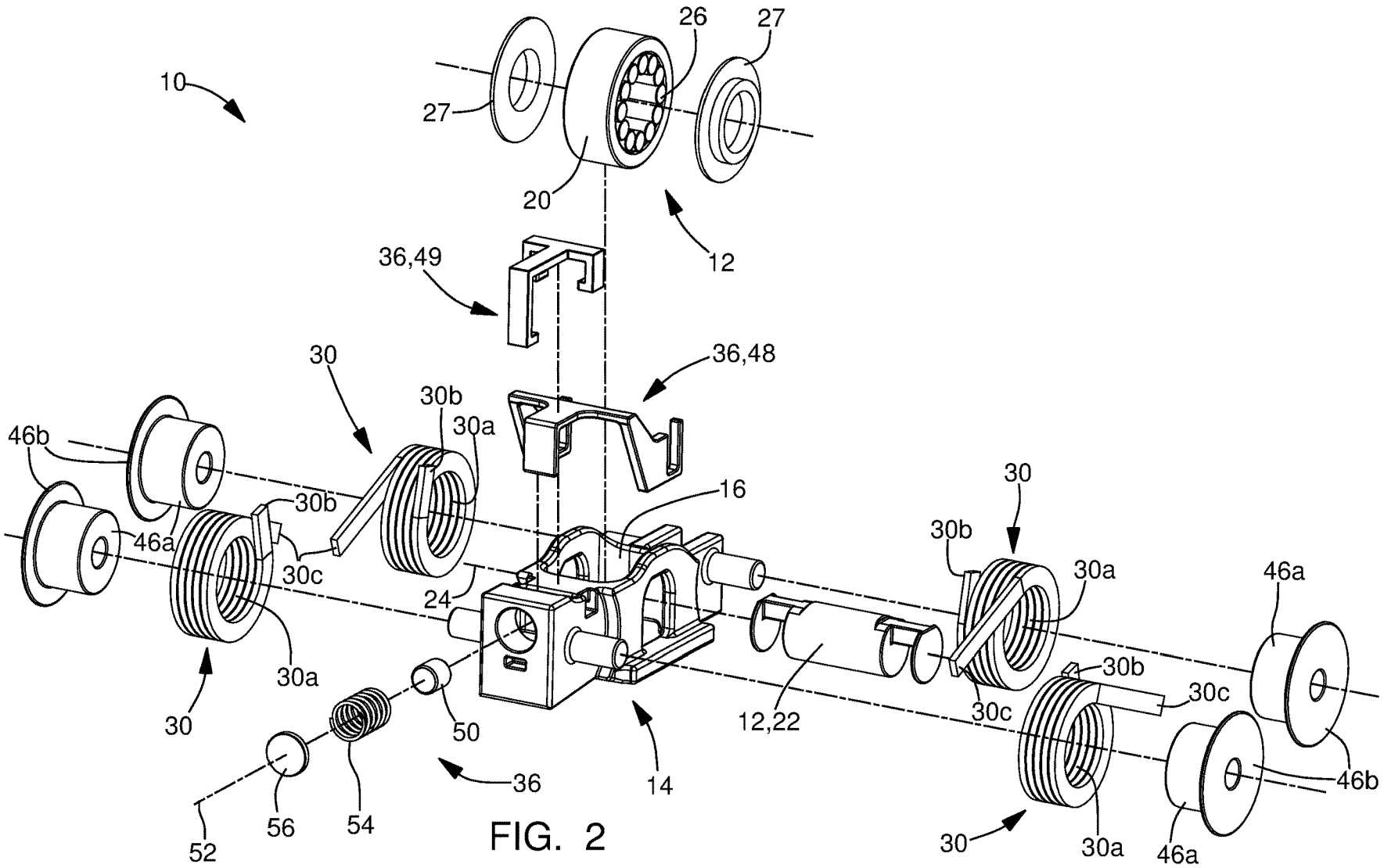
FIG. 2 is an exploded isometric view of the rocker arm of FIG. 1.

Referring initially to FIGS. 1-7B, a rocker arm 10 in accordance with the invention is illustrated where rocker arm 10 is presented for illustrative purposes as a deactivation rocker arm but may alternatively be a two-step rocker arm, both of which may generically be referred to as a switchable rocker arm. Rocker arm 10 is included in valve train (not shown) of an internal combustion engine (not shown) in order to translate rotational motion of a camshaft 11 about a camshaft axis 11*a* to reciprocating motion of a combustion valve (not shown). As is known in the art of combustion valve actuation, camshaft 11 includes a base circle 11*b* which is centered about camshaft axis 11*a* and a lifting portion 11*c* which is eccentric to camshaft axis 11*a*. In this way, base circle 11*b* does not induce movement on the combustion valve while lifting portion 11*c* opens and closes the combustion valve. Rocker arm 10 includes an inner follower 12 that is disposed in a central opening 16 in a body 14. Inner follower 12 selectively reciprocates within central opening 16 along a reciprocation axis 18 relative to body 14 where it is important to note that reciprocation axis 18 is linear. Inner follower 12 may comprise a roller 20 carried by a roller shaft 22 such that roller 20 is centered about, and rotates about, a roller shaft axis 24. Roller 20 is configured to follow base circle 11*b* and lifting portion 11*c*, to selectively impart lifting motion on a respective combustion valve. Roller 20 is cylindrical and tubular as shown such that a plurality of bearings 26 may rotatably support roller 20 on roller shaft 22 for following base circle 11*b* and lifting portion 11*c* of camshaft 11 such that bearings 26 may be, for example, a plurality of rollers or needle bearings. Inner follower 12 may further comprise a pair of bearing retainers 27 such that bearing retainers 27 are each positioned on opposing axial ends of roller 20. Bearing retainers 27 are each annular in shape such that roller shaft 22 passes therethrough and such that the outer periphery of bearing retainers 27 extends sufficiently far to cause bearings 26 to be captured axially, parallel to roller shaft axis 24, between bearing retainers 27, thereby retaining bearings 26 within roller 20. Body 14 includes a first wall 28 and a second wall 29 which are parallel to each other such that first wall 28 and second wall 29 are perpendicular to roller shaft axis 24 and such that first wall 28 and second wall 29 are spaced apart from each other in the direction of roller shaft axis 24 to define central opening 16 therebetween. One or more lost motion springs 30 act between inner follower 12 and body 14 to bias inner follower 12 away from body 14 in a first direction, shown as upward as viewed in FIGS. 3-6. A socket 32 for pivotably mounting rocker arm 10 on a lash adjuster (not shown) is included at a first end 14*a* of body 14 while a pad 34 for actuating a valve stem (not shown) is proximal to a second end 14*b* of body 14. A latching arrangement 36 selectively permits inner follower 12 to reciprocate relative to body 14 along reciprocation axis 18 and also selectively prevents inner follower 12 from reciprocating relative to body 14 along reciprocation axis 18 in a second direction, illustrated as downward as viewed in FIGS. 3-6, which is opposite of the first direction. While body 14 has been illustrated herein as not including followers which follow respective profiles of camshaft 11, it should be understood that body 14 may include followers such as rollers as shown in U.S. Pat. No. 7,305,951 or such as sliding surfaces as shown in U.S. Pat. No. 7,882,814 to Spath et al. and U.S. Pat. No. 6,668,779 to Hendriksma et al., the disclosures of each of which are hereby incorporated by reference in their entirety. When included, the followers of the outer arms are utilized to follow a profile of camshaft 11 which is a circle in the case of rocker arm 10 being a deactivation rocker arm and the followers of the outer arm are utilized to follow a profile of camshaft 11 which includes an eccentric portion similar to lifting portion 11*c* which provides a different magnitude or duration of lifting motion to rocker arm 10 in the case of rocker arm 10 being a two-step rocker arm. Furthermore, while inner follower 12 has been illustrated herein as including roller 20 for following base circle 11*b* and lifting portion 11*c*, it should be understood that inner follower 12 may alternatively use a sliding surface as the follower instead of a roller as illustrated in U.S. Pat. No. 7,305,951.

Body 14 includes an body first end bridge 38 at first end 14*a* and an body second end bridge 40 at second end 14*b*. Body first end bridge 38 joins first wall 28 and second wall 29 proximal to first end 14*a* and also defines socket 32 therein. Similarly, body second end bridge 40 joins first wall 28 and second wall 29 proximal to second end 14*b* and also defines pad 34 thereon. First wall 28, second wall 29, body first end bridge 38, and body second end bridge 40 may comprise a single piece of material which is formed, by way of non-limiting example, by casting, forging, machining from solid, combinations thereof, and the like. Body first end bridge 38 and body second end bridge 40 each include two spring bosses 42 extending outward therefrom such that the spring bosses 42 of body first end bridge 38 extend therefrom along a first spring boss axis 42*a* which is parallel to roller shaft axis 24 and such that spring bosses 42 of body second end bridge 40 extend therefrom along a second spring boss axis 42*b* which is parallel to roller shaft axis 24. Spring bosses 42 of body first end bridge 38 extend from opposing sides of body first end bridge 38 and each may be circular in cross-section as shown when sectioned perpendicular to first spring boss axis 42*a*. Similarly, spring bosses 42 of body second end bridge 40 extend from opposing sides of body second end bridge 40 and each may be circular in cross-section as shown when sectioned perpendicular to second spring boss axis 42*b*. Spring bosses 42 are preferably formed as a single piece of material with first wall 28, second wall 29, body first end bridge 38, and body second end bridge 40.

First wall 28 of body 14 includes a first wall inner surface 28*a* which faces toward central opening 16 and a first wall outer surface 28*b* which is opposed to first wall inner surface 28*a* on the exterior of body 14. A first wall aperture 28*c* extends through first wall 28 from first wall outer surface 28*b* to first wall inner surface 28*a* along roller shaft axis 24. A first rail 28*d* extends outward from first wall outer surface 28*b* and includes a first rail surface 28*e* which is parallel to roller shaft axis 24 and normal to reciprocation axis 18 and which may be perpendicular to first wall outer surface 28*b* as shown. Similarly, second wall 29 of body 14 includes a second wall inner surface 29*a* which faces toward central opening 16 and a second wall outer surface 29*b* which is opposed to second wall inner surface 29*a* on the exterior of body 14. A second wall aperture 29*c* extends through second wall 29 from second wall outer surface 29*b* to second wall inner surface 29*a* along roller shaft axis 24. A second rail 29*d* extends outward from second wall outer surface 29*b* and includes a second rail surface 29*e* which is parallel to roller shaft axis 24 and perpendicular to reciprocation axis 18 and which may be perpendicular to second wall outer surface 29*b* as shown.

Lost motion springs 30 are each coil torsion springs which are mounted to respective spring bosses 42 using a respective lost motion spring retainer 46. Each lost motion spring 30 includes a plurality of coils, thereby defining a lost motion spring aperture 30*a* within which a respective spring boss 42 and a respective lost motion spring retainer 46 are located. Each lost motion spring retainer 46 includes spring retainer retention section 46*a* which surrounds and grips a respective spring boss 42 and also includes a spring retainer flange 46*b* which extends radially outward from spring retainer retention section 46*a* such that lost motion spring 30 is captured axially between spring retainer flange 46*b* and body 14. Lost motion spring retainer 46 may be fixed to spring boss 42, by way of non-limiting example only, by interferences fit, welding, adhesives, threaded connection, two or more of the foregoing, and the like. Each lost motion spring 30 includes a lost motion spring body tang 30*b* at one end thereof which is grounded to body 14 and also includes a lost motion spring inner follower tang 30*c* at the other end thereof which is grounded to inner follower 12 on roller shaft 22 as will be described in greater detail later. While rocker arm 10 has been illustrated as including four lost motion springs 30, it should be understood that a lesser number or a greater number of lost motion springs 30 may be provided.

Figure 8:
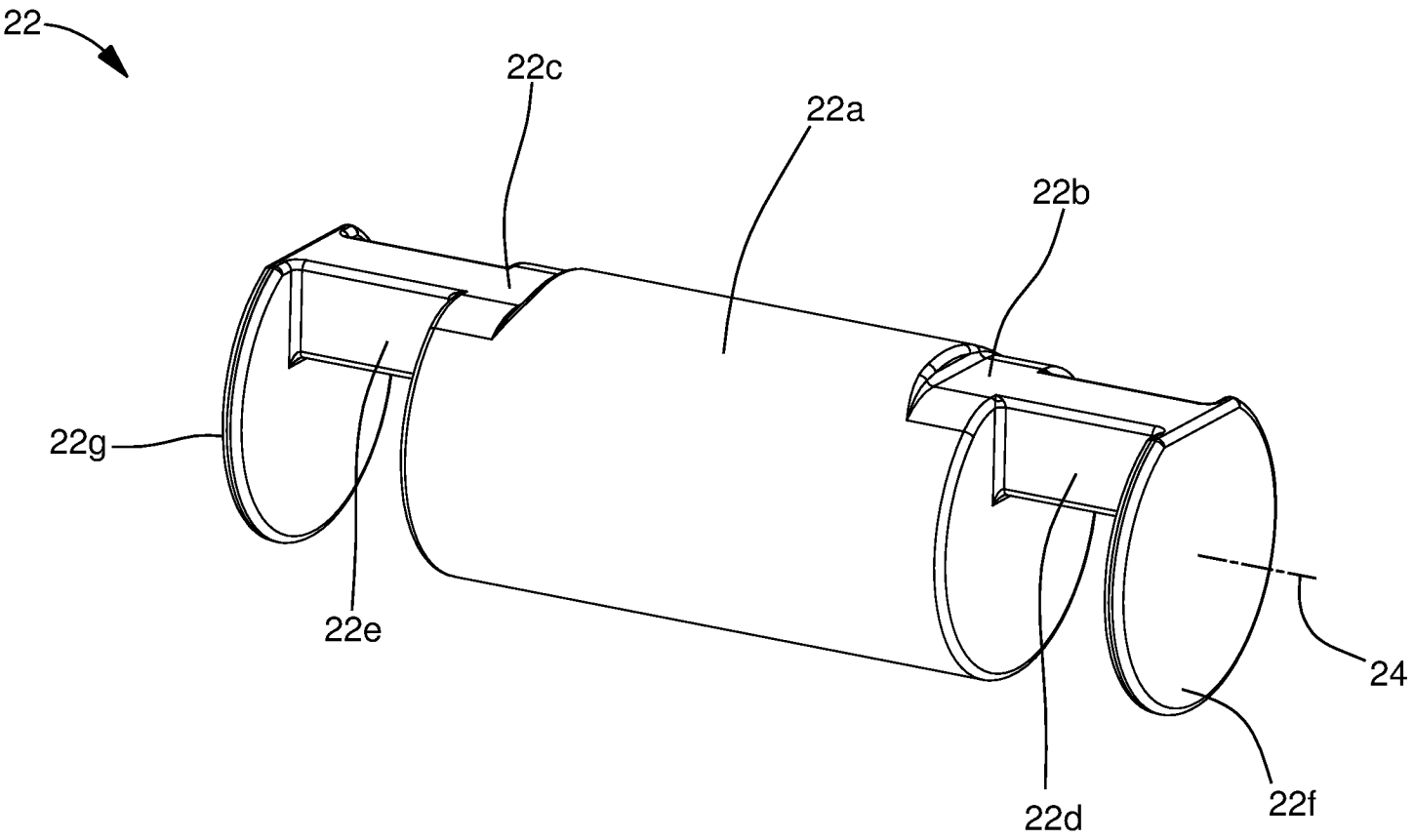
FIG. 8 is an isometric view of the roller shaft of the rocker arm of FIG. 1.
Figure 9A:
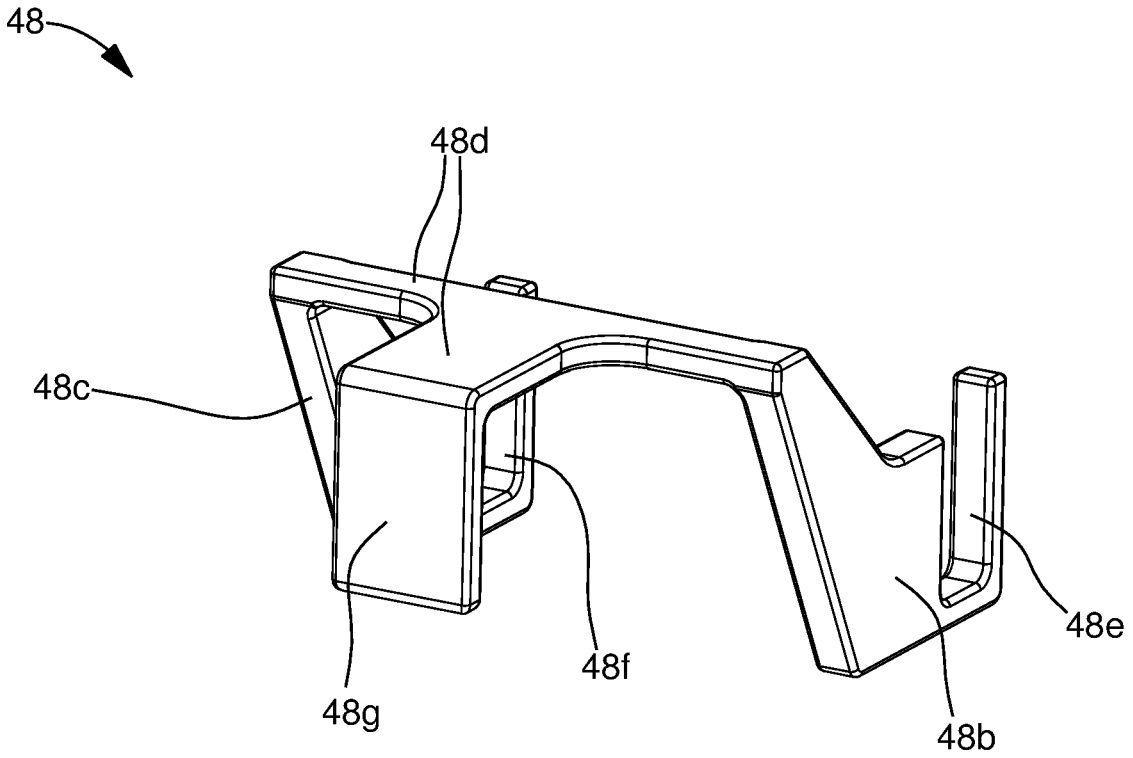
FIGS. 9A and 9B are isometric views of a lock member of the rocker arm of FIG. 1.
Figure 9B:
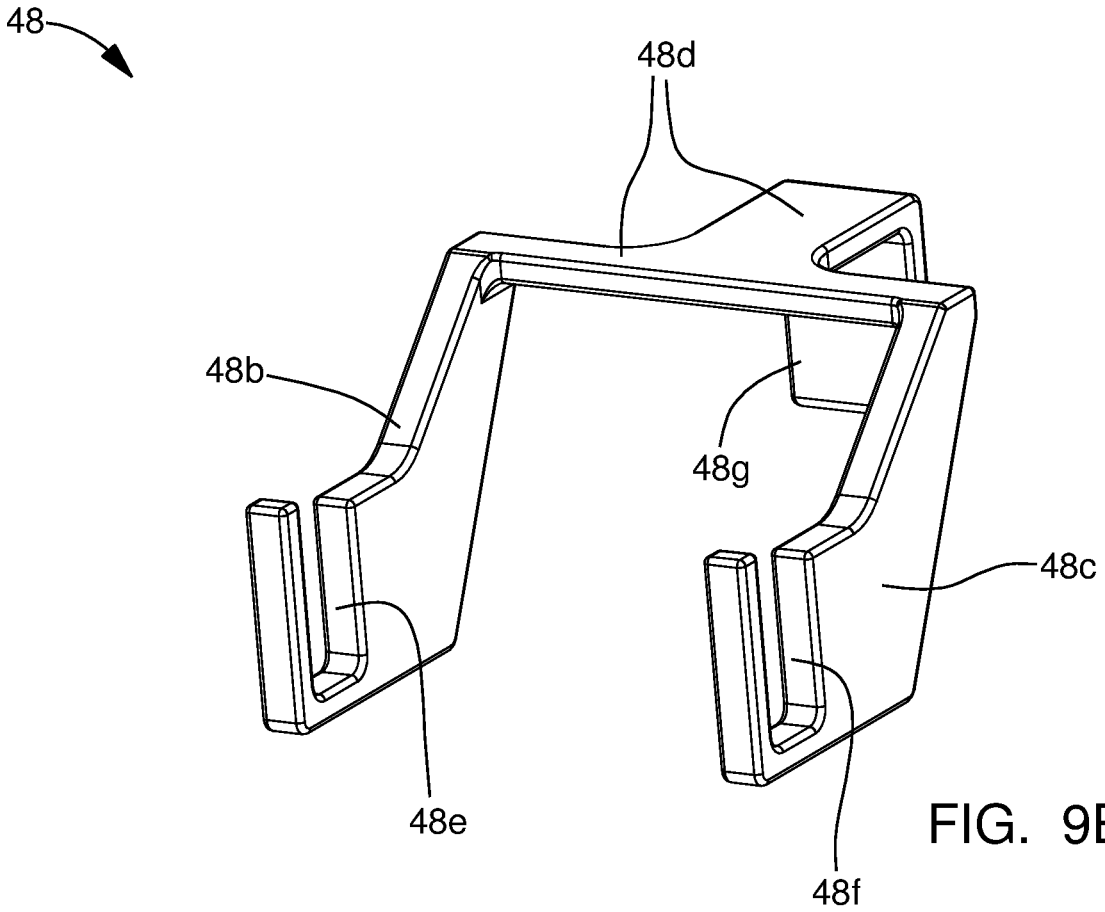
Figure 10A:
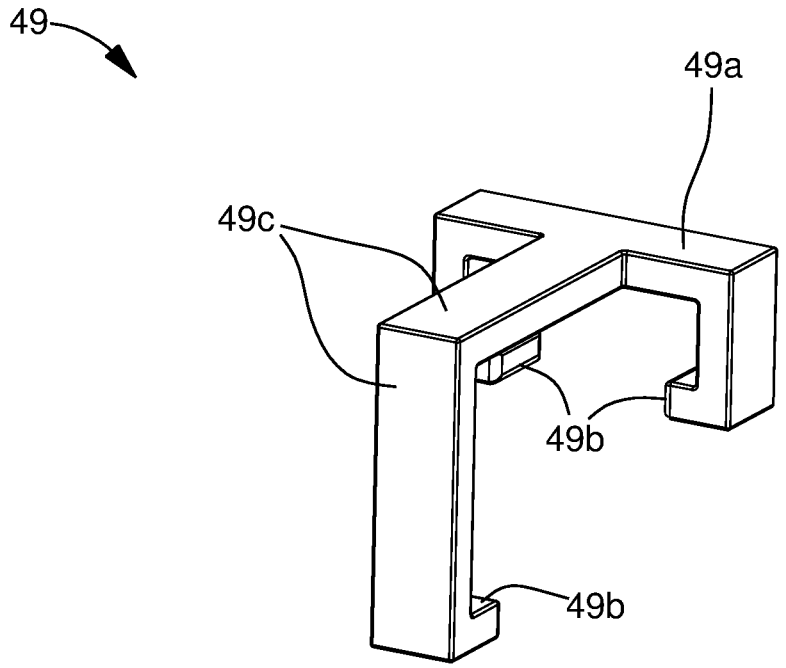
FIGS. 10A and 10B are isometric views of a lock member retainer of the rocker arm of FIG. 1.
Figure 10B:
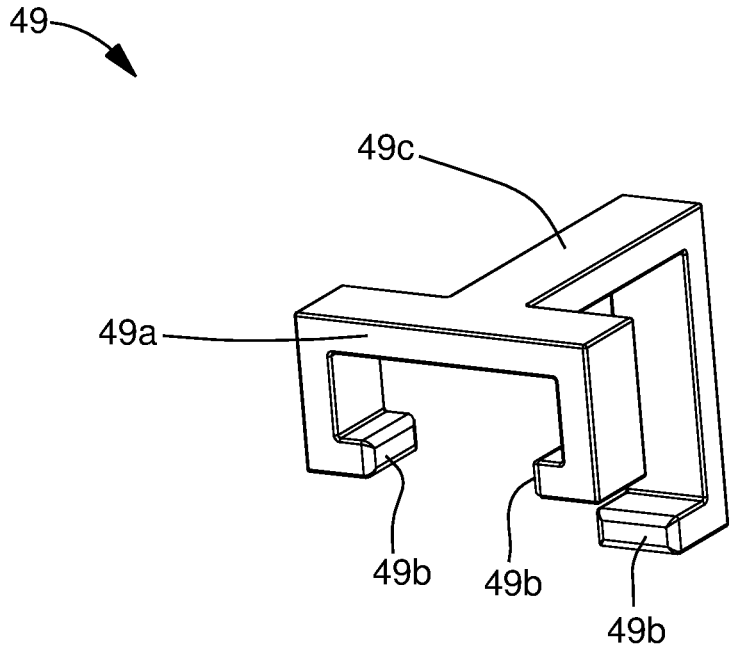

With continued reference to FIGS. 1-7B and now with additional reference to FIG. 8, roller shaft 22 includes a central portion 22*a* which is cylindrical and centered about roller shaft axis 24. Central portion 22*a* is located within central opening 16 and provides the surface upon which bearings 26 ride to support roller 20 such that roller 20 circumferentially surrounds central portion 22*a*. Roller shaft 22 also includes an inner follower first portion 22*b* which extends from one axial end of central portion 22*a* and an inner follower second portion 22*c* which extends from the other axial end of central portion 22*a* such that inner follower first portion 22*b* extends through first wall aperture 28*c* and such that inner follower second portion 22*c* extends through second wall aperture 29*c*. Inner follower first portion 22*b* has an inner follower first portion orienting feature 22*d* which is generally rectangular or square in cross-sectional shape when sectioned perpendicular to roller shaft axis 24 and which is located outside of body 14. Similarly, inner follower second portion 22*c* has an inner follower second portion orienting feature 22*e* which is generally rectangular or square in cross-sectional shape when sectioned perpendicular to roller shaft axis 24 and which is located outside of body 14. Both inner follower first portion orienting feature 22*d* and inner follower second portion orienting feature 22*e* are eccentric to roller shaft axis 24, i.e. are not centered about roller shaft axis 24, and each include opposing flat sides which are parallel to each other. Inner follower first portion orienting feature 22*d* and inner follower second portion orienting feature 22*e* prevent rotation of roller shaft 22 about roller shaft axis 24 as will be described later and also provide a surface upon which lost motion spring inner follower tangs 30*c* are grounded. In order to prevent lost motion spring inner follower tangs 30*c* from slipping off the ends of roller shaft 22, inner follower first portion orienting feature 22*d* and inner follower second portion orienting feature 22*e* include roller shaft first flange 22*f* and roller shaft second flange 22*g* respectively. Consequently, lost motion spring inner follower tangs 30*c* are capture axially, i.e. in a direction parallel to roller shaft axis 24, between roller shaft first flange 22*f* and body 14 or between roller shaft second flange 22*g* and body 14.

Figure 3:
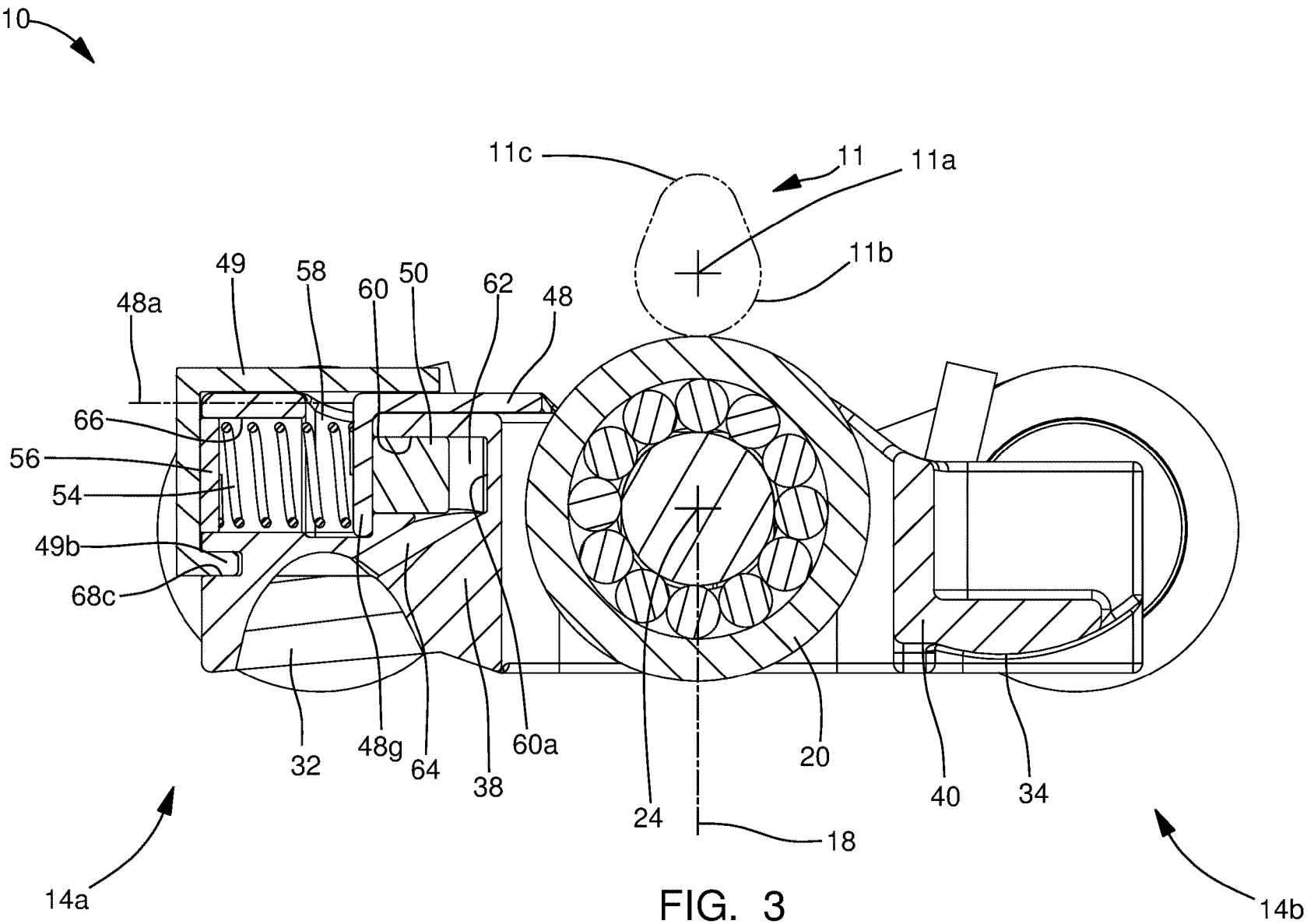
FIG. 3 is a cross-sectional view of the rocker arm of FIG. 1, taken through a section plane that is perpendicular to a roller shaft axis of an inner follower of the rocker arm, showing the rocker arm when a latching arrangement of the rocker arm in a coupled state.
Figure 4:
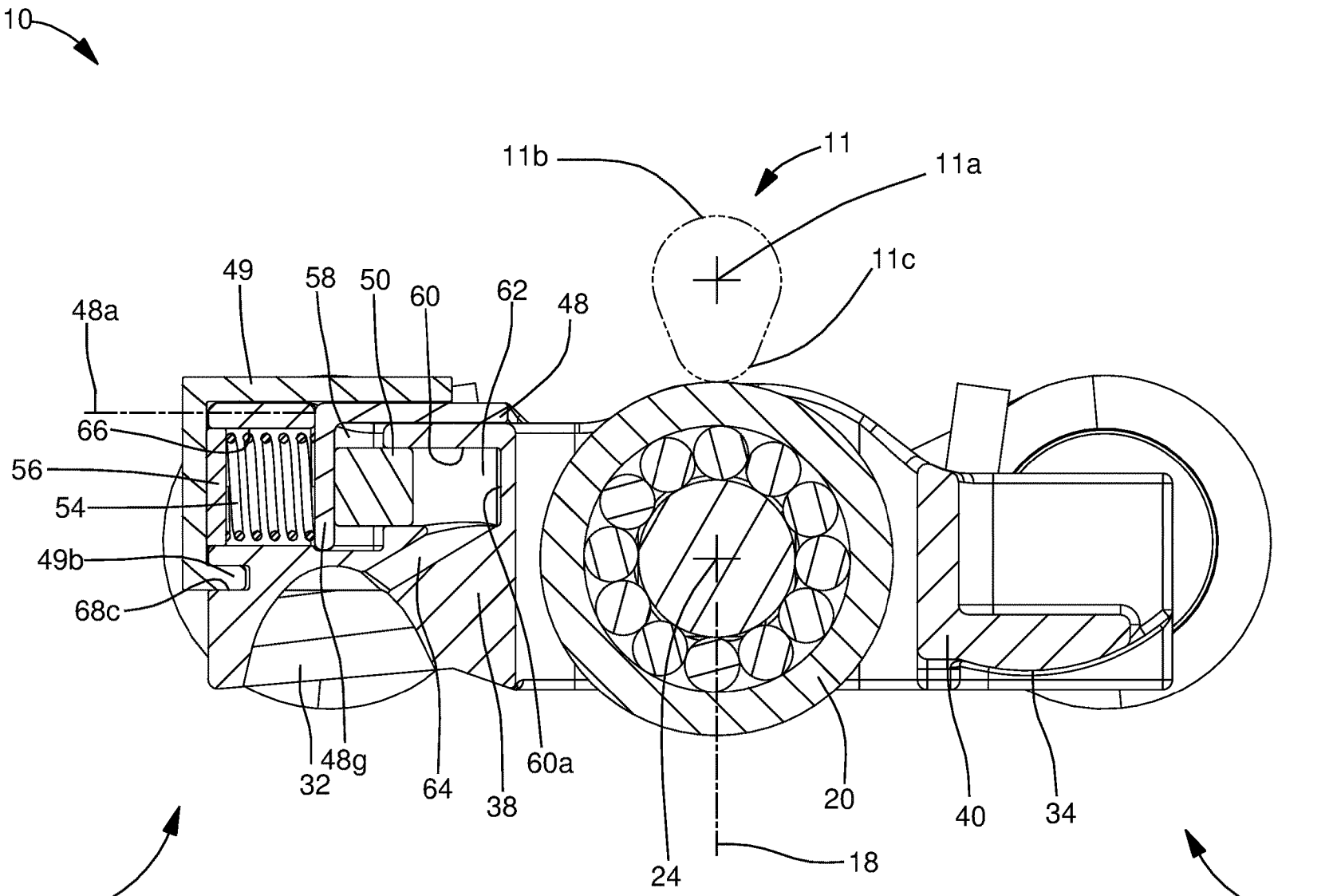
FIG. 4 is the cross-sectional view of FIG. 3, now showing the rocker arm when the latching arrangement in a decoupled state.
Figure 5:
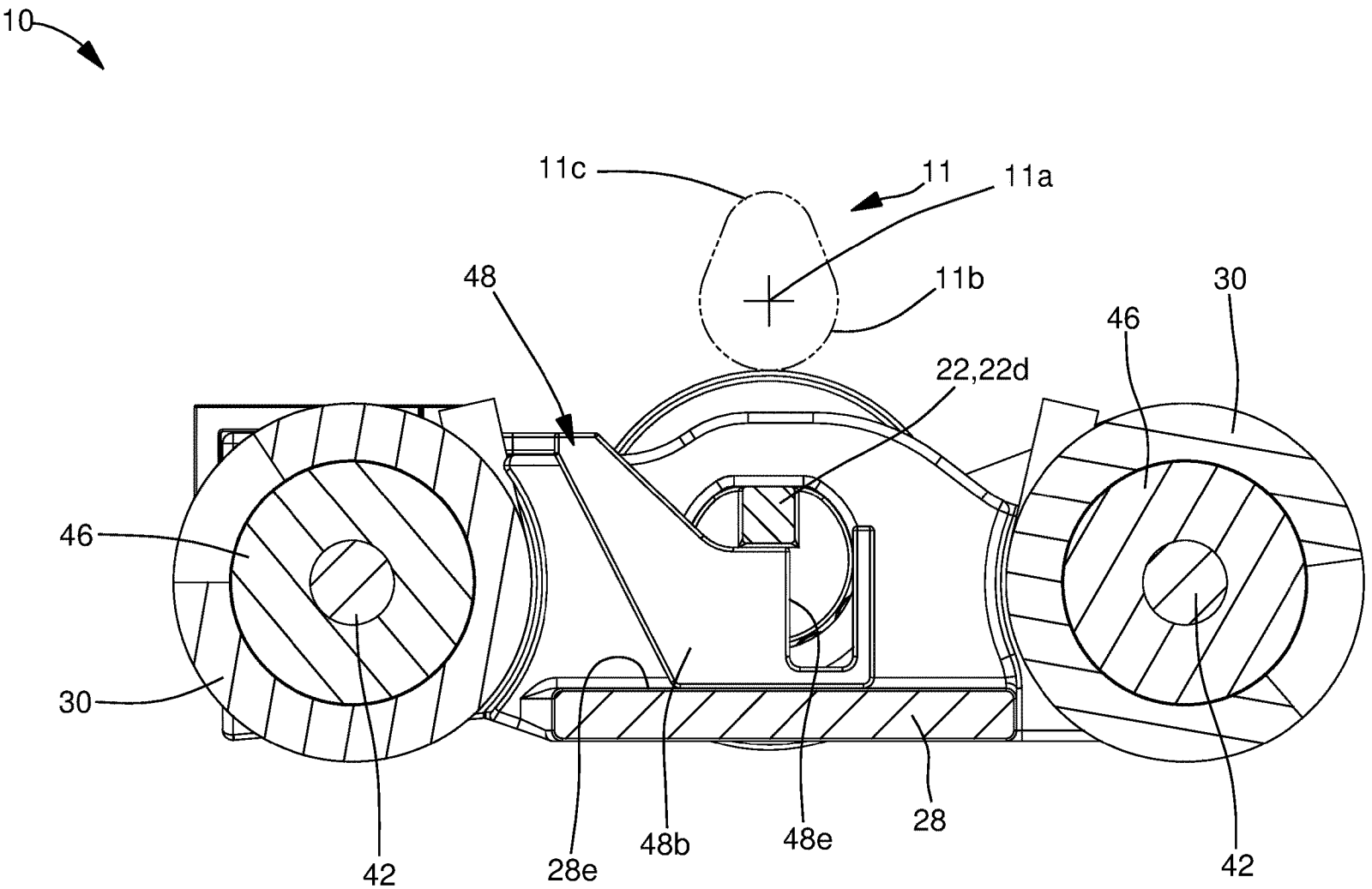
FIG. 5 is a cross-sectional view of the rocker arm of FIG. 1 taken through a section plane that is parallel to the section plane of FIG. 3, showing the latching arrangement in the coupled state.
Figure 6:
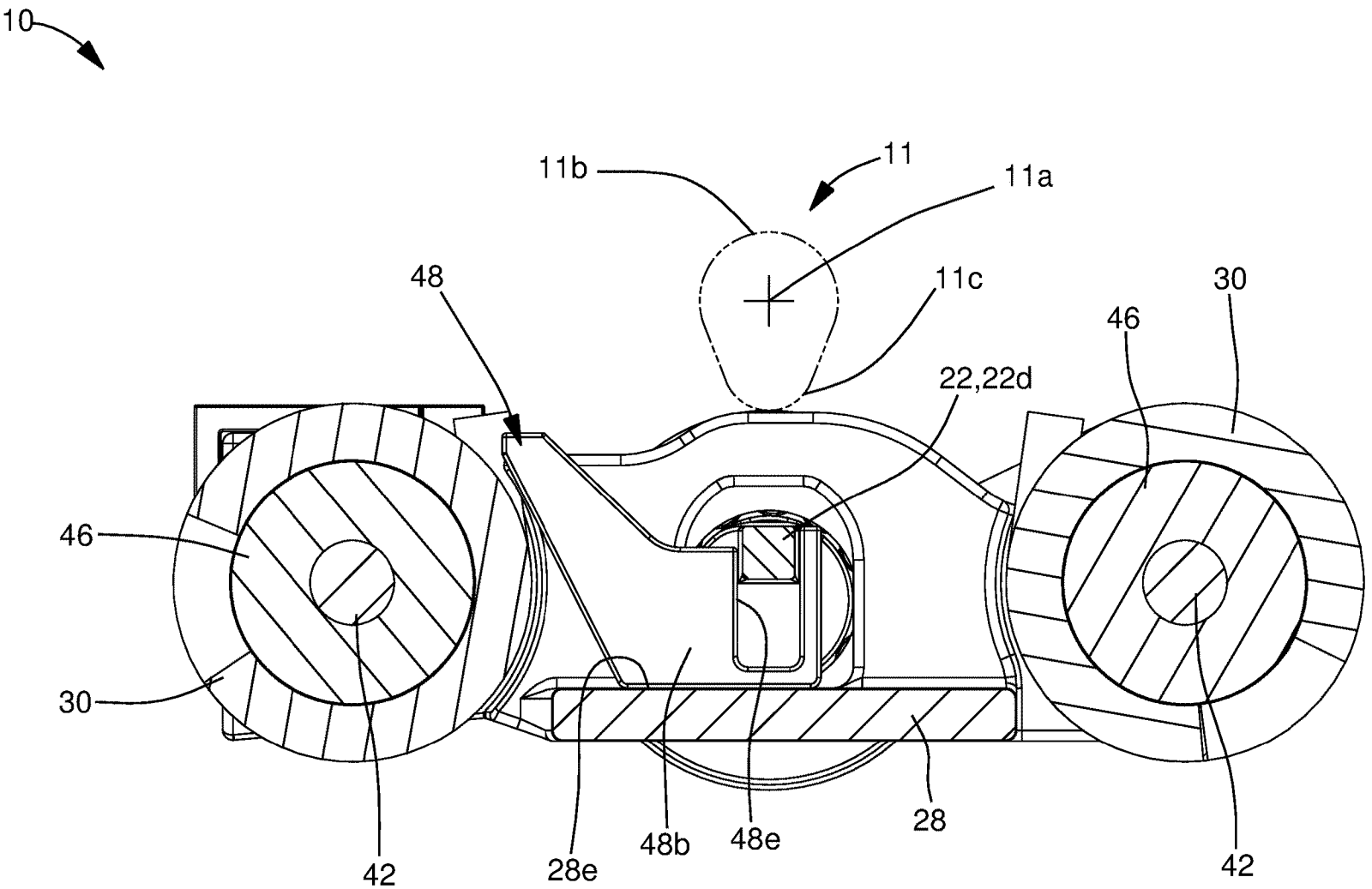
FIG. 6 is the cross-sectional view of FIG. 5, now showing the latching arrangement in the decoupled state.
Figure 7A:
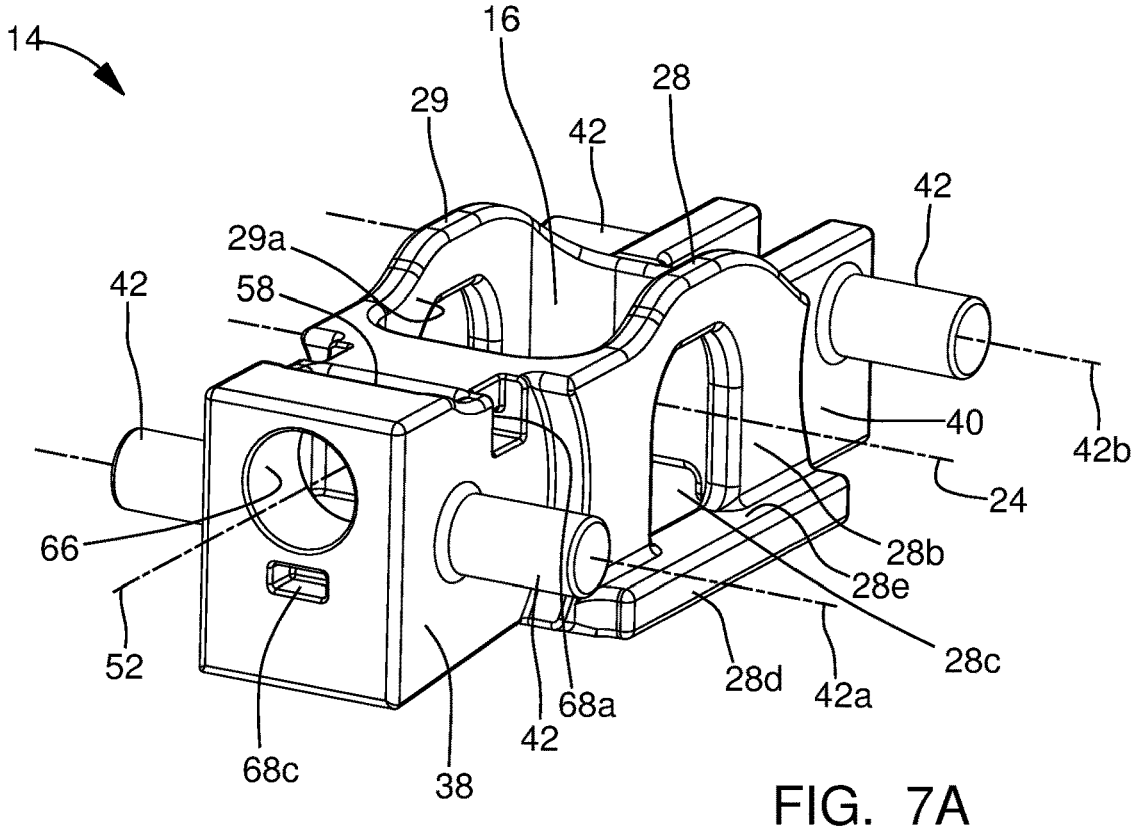
FIGS. 7A and 7B are isometric views of a body of the rocker arm of FIG. 1.
Figure 7B:
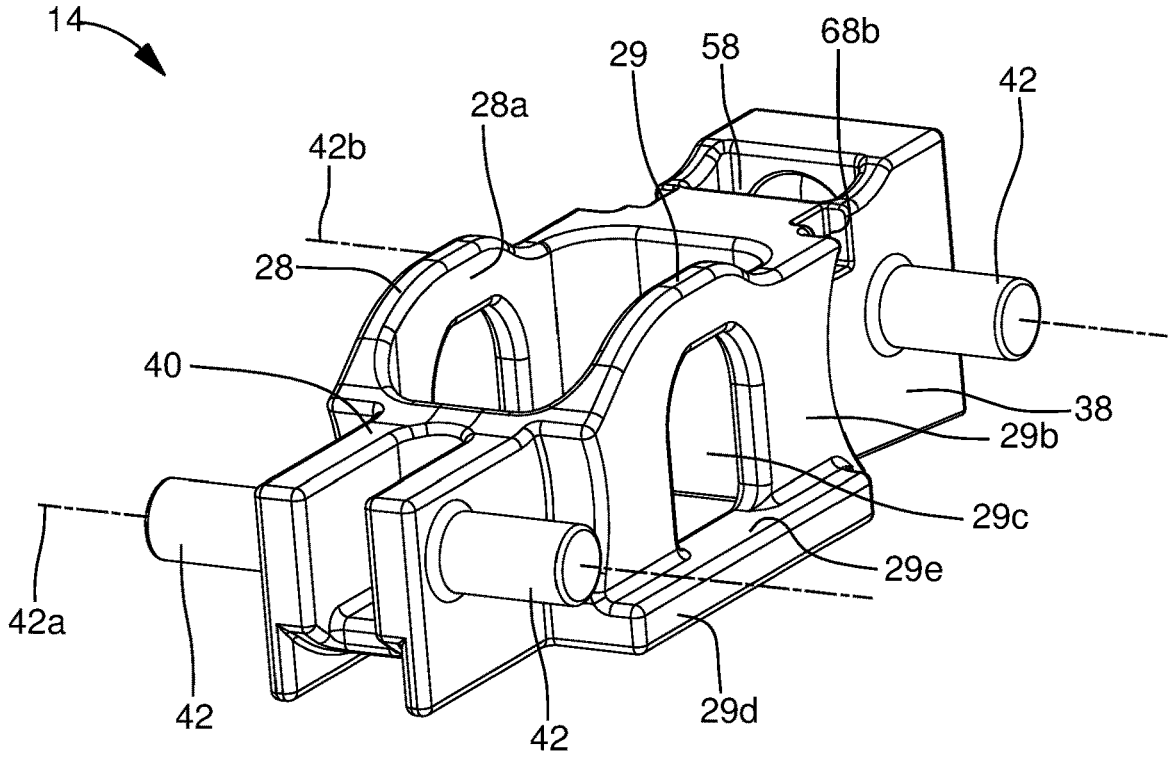

Rocker arm 10 is selectively switched between a coupled state and a decoupled state by latching arrangement 36 which is actuated, by way of non-limiting example only, by application of pressurized oil and draining the pressurized oil as embodied herein or by an actuator such as a solenoid actuator (not shown). In the coupled state as shown in FIGS. 3 and 5, inner follower 12 is prevented from reciprocating relative to body 14 past a predetermined position of inner follower 12 relative to body 14 in the second direction which is downward as viewed in FIGS. 3 and 5. In this way, in the coupled state, inner follower 12, and therefore roller shaft 22, is coupled to body 14, and rotation of lifting portion 11*c* is transferred from first roller 20*a* and second roller 20*b* through roller shaft 22 to reciprocating movement of body 14 about the lash adjuster which, in turn, reciprocates the associated valve. In the decoupled state as shown in FIGS. 4 and 6, inner follower 12 is able to move relative to body 14 past the predetermined position in the second direction. In this way, in the decoupled state, inner follower 12, and therefore roller shaft 22, is decoupled from body 14. Thus, roller shaft 22 does not transfer rotation of the lifting cam to pivotal movement of body 14, and the associated valve is not reciprocated. Rather, inner follower 12, reciprocate within central opening 16 along reciprocation axis 18, thereby compressing and uncompressing lost motion springs 30 in a cyclic manner such that lost motion springs 30 bias inner follower 12 to move relative to body 14 in the first direction, shown as upward as viewed in FIGS. 4 and 6.

Latching arrangement 36 will now be described in greater detail with continued reference to FIGS. 1-7B and now with additional reference to FIGS. 9A, 9B, 10A, and 10B. Latching arrangement 36 includes a lock member 48 which is slidably disposed on body 14; a lock member retainer 49 which retains lock member 48 to body 14; a piston 50 which slides along a piston axis 52 between a first position, shown in FIG. 3 and a second position, shown in FIG. 4, a return spring 54 located within body 14; and a return spring retainer 56 which retains return spring 54 within body 14. The elements of latching arrangement 36 will be described in the paragraphs that follow.

Lock member 48 is moveable along a lock member axis 48*a* between 1) a coupled position in which lock member 48 engages inner follower first portion 22*b* and inner follower second portion 22*c* (more specifically, lock member 48 engages the lower surfaces, as viewed in FIG. 8, of inner follower first portion 22*b*/inner follower first portion orienting feature 22*d* and inner follower second portion 22*c*/inner follower second portion orienting feature 22*e*), thereby preventing inner follower 12 from moving relative to body 14 along reciprocation axis 18 past the predetermined position in the second direction and 2) a decoupled position in which lock member 48 permits inner follower 12 to move relative to body 14 along reciprocation axis 18 past the predetermined position in the second direction. Lock member axis 48*a* may be normal to reciprocation axis 18 as illustrated in the figures. Also as shown in the figures, lock member 48 engages inner follower first portion 22*b* and inner follower second portion 22*c* outside of central opening 16 when lock member 48 is in the coupled position.

Lock member 48 includes a lock member first branch 48*b* which faces toward first wall outer surface 28*b* and also includes a lock member second branch 48*c* which faces toward second wall outer surface 29*b*. In this way, body 14 is located between lock member first branch 48*b* and lock member second branch 48*c*. Lock member first branch 48*b* and lock member second branch 48*c* are planar and parallel to each and joined to each other by a lock member bridge 48*d* which crosses over body first end bridge 38. Lock member first branch 48*b* slides against first rail surface 28*e*, which is parallel to lock member axis 48*a*, when moving between the coupled position and the decoupled position, and similarly, lock member second branch 48*c* slides against second rail surface 29*e*, which is parallel to lock member axis 48*a*, when moving between the coupled position and the decoupled position. Lock member first branch 48*b* includes a lock member first branch slot 48*e* with which inner follower first portion orienting feature 22*d* is aligned when lock member 48 is in the decoupled position, thereby allowing inner follower first portion orienting feature 22*d* to reciprocate within lock member first branch slot 48*e*. However, inner follower first portion orienting feature 22*d* is not aligned with lock member first branch slot 48*e* when lock member 48 is in the coupled position, thereby preventing movement of inner follower 12 past the predetermined position. Similarly, lock member second branch 48*c* includes a lock member second branch slot 48*f* with which inner follower second portion orienting feature 22*e* is aligned when lock member 48 is in the decoupled position, thereby allowing inner follower second portion orienting feature 22*e* to reciprocate within lock member second branch slot 48*f*. However, inner follower second portion orienting feature 22*e* is not aligned with lock member second branch slot 48*f* when lock member 48 is in the coupled position, thereby preventing movement of inner follower 12 past the predetermined position. It should be noted that the rectangular cross-sectional nature of inner follower first portion orienting feature 22*d* and inner follower second portion orienting feature 22*e* allows for engagement with lock member first branch 48*b* and lock member second branch 48*c* respectively, thereby preventing rotation of roller shaft 22 about roller shaft axis 24. Lock member 48 also includes a lock member actuation arm 48*g* which extends from lock member bridge 48*d* into a body lock member actuation arm slot 58 which extends into body first end bridge 38. The function of lock member actuation arm 48*g* will be described in greater detail later. Lock member 48 may be made from stamping and forming sheet metal through common stamping, punching, and bending techniques.

Piston 50 is located within a piston bore 60 formed within body first end bridge 38. Piston bore 60 is centered about, and extends along, piston axis 52 and furthermore, piston bore 60 extends from body lock member actuation arm slot 58 and is terminated by a piston bore end wall 60*a* such that a pressure chamber 62 is formed axially between piston 50 and piston bore end wall 60*a*. Piston 50 is sized to interface with piston bore 60 in a close sliding fit which prevents oil from passing between the interface of piston 50 and piston bore 60 while allowing piston 50 to freely slide within piston bore 60. An oil passage 64 extends from socket 32 to pressure chamber 62, thereby providing a path for pressurized oil to be supplied to and drained from pressure chamber 62 in order to alter the position of piston 50 such that piston 50 slides between the first position and the second position based on the pressure of oil within pressure chamber 62, thereby altering the position of lock member 48. When pressurized oil is supplied to pressure chamber 62, by way of non-limiting example from the lubrication system of an internal combustion engine (not shown), piston 50 acts upon lock member actuation arm 48*g*, thereby causing lock member 48 to move from the coupled position to the decoupled position.

Return spring 54 is located within a return spring bore 66 formed within body first end bridge 38. Return spring bore 66 is centered about, and extends along, piston axis 52 and furthermore, return spring bore 66 extends from body lock member actuation arm slot 58 in a direction opposite from piston bore 60. Return spring 54 is held in compression between lock member actuation arm 48*g* and return spring retainer 56 which is fixed within the end of return spring bore 66 that is distal from body lock member actuation arm slot 58. In this way, return spring 54 engages lock member 48 and biases lock member 48 toward the coupled position. Return spring retainer 56 may be fixed within return spring bore 66 by way of non-limiting example only, by interferences fit, welding, adhesives, threaded connection, two or more of the foregoing, and the like. When pressurized oil is supplied to pressure chamber 62, movement of piston 50 from the first position to the second position which causes lock member 48 to move from the coupled position to the decoupled position also causes return spring 54 to be compressed further. Conversely, when pressurized oil is drained from pressure chamber 62, return spring 54 acting on lock member actuation arm 48*g* causes piston 50 to move from the second position to the first position when lock member 48 moves from the decoupled position to the coupled position.

Lock member retainer 49 is fixed to body 14 as will be described and retains lock member 48 to body 14 by capturing lock member bridge 48*d* between lock member retainer 49 and body first end bridge 38. Lock member retainer 49 includes a lock member retainer first link 49*a* which extends across body first end bridge 38 in a direction parallel to roller shaft axis 24 such that opposing ends of lock member retainer first link 49*a* includes a respective lock member retainer hook 49*b* which is received within a complementary first recess 68*a* and a complementary second recess 68*b* respectively formed on body first end bridge 38. Lock member retainer 49 also includes a lock member retainer second link 49*c* which extends from lock member retainer first link 49*a* in a direction parallel to piston axis 52. The end of lock member retainer second link 49*c* which is distal from lock member retainer first link 49*a* includes another lock member retainer hook 49*b* which is received within a third recess 68*c* which is formed in the axial end of body first end bridge 38 which is distal from central opening 16. One or more of lock member retainer first link 49*a*, lock member retainer hooks 49*b*, and lock member retainer second link 49*c* may be elastically deformed to allow application of lock member retainer 49 to body 14, thereby allowing lock member retainer hooks 49*b* to snap into respective first recess 68*a*, second recess 68*b*, and third recess 68*c* to fix lock member retainer 49 to body 14, thereby retaining lock member 48. Lock member retainer 49 may be made from stamping and forming sheet metal through common stamping, punching, and bending techniques.

While rocker arm 10 has been illustrated herein as defaulting to the coupled position, it should be understood that rocker arm 10 may alternatively be arranged to defaulting to decoupled position. This may be accomplished by reversing the position of piston 50 and return spring 54 or alternatively by altering the position of lock member first branch slot 48*e* and lock member second branch slot 48*f*.

Rocker arm 10 as described herein allows for linear reciprocation of inner follower 12 while providing compactness and ease of assembly.

While this invention has been described in terms of preferred embodiments thereof, it is not intended to be so limited, but rather only to the extent set forth in the claims that follow.

I claim:

1. A rocker arm for transmitting rotational motion from a camshaft to opening and closing motion of a combustion valve in an internal combustion engine, said rocker arm comprising:

a body having a first wall and a second wall spaced laterally from said first wall such than a central opening is provided between said first wall and said second wall, said first wall having a first wall aperture extending therethrough along an axis and said second wall having a second wall aperture extending therethrough along said axis;

an inner follower which selectively reciprocates along a reciprocation axis relative to said body, said inner follower being located within said central opening and being configured to follow a lobe of said camshaft, said inner follower having an inner follower first portion which extends through said first wall aperture and also having an inner follower second portion which extends through said second wall aperture;

a lost motion spring which biases said inner follower to move relative to said body along said reciprocation axis in a first direction; and a lock member moveable along a lock member axis between 1) a coupled position in which said lock member engages said inner follower first portion and said inner follower second portion, thereby preventing said inner follower from moving relative to said body along said reciprocation axis past a predetermined position of said inner follower relative to said body in a second direction which is opposite of said first direction and 2) a decoupled position in which said lock member permits said inner follower to move relative to said body along said reciprocation axis past said predetermined position in said second direction.

2. The rocker arm as in claim 1, wherein said reciprocation axis is normal to said lock member axis.

3. The rocker arm as in claim 1, wherein said lock member engages said inner follower first portion and said inner follower second portion outside of said central opening when said lock member is in said coupled position, thereby preventing said inner follower from moving relative to said body along said reciprocation axis past said predetermined position in said second direction which is opposite of said first direction.

4. The rocker arm as in claim 1, wherein:

said first wall has a first wall inner surface which faces toward said central opening and a first wall outer surface which is opposed to said first wall inner surface;

said second wall has a second wall inner surface which faces toward said central opening and a second wall outer surface which is opposed to said second wall inner surface; and said lock member includes a lock member first branch which faces toward said first wall outer surface and also includes a lock member second branch which faces toward said second wall outer surface.

5. The rocker arm as in claim 4, wherein:

a first rail extends outward from said first wall outer surface and includes a first rail surface which is parallel to said lock member axis such that said lock member first branch slides against said first rail surface when moving between the coupled position and the decoupled position; and a second rail extends outward from said second wall outer surface and includes a second rail surface which is parallel to said lock member axis such that said lock member second branch slides against said second rail surface when moving between the coupled position and the decoupled position.

6. The rocker arm as in claim 5, wherein:

said first rail surface is perpendicular to said first wall outer surface; and said second rail surface is perpendicular to said second wall outer surface.

7. The rocker arm as in claim 5, wherein:

said first rail surface is normal to said reciprocation axis; and said second rail surface is normal to said reciprocation axis.

8. The rocker arm as in claim 4, wherein:

said lock member first branch includes a lock member first branch slot within which said inner follower first portion is located when said inner follower reciprocates along said reciprocation axis; and said lock member second branch includes a lock member second branch slot within which said inner follower second portion is located when said inner follower reciprocates along said reciprocation axis.

9. The rocker arm as in claim 4, wherein said lock member includes a lock member bridge which joins said lock member first branch to said lock member second branch.

10. The rocker arm as in claim 9, wherein:

said body includes a piston bore within which a piston is located such that the piston slides between a first position and a second position;

said lock member includes a lock member actuation arm upon which said piston acts when said piston moves from said first position to said second position, thereby causing said lock member to move to one of said coupled position and said decoupled position.

11. The rocker arm as in claim 10, wherein said rocker arm further comprises a return spring which engages said lock member and biases said lock member toward the other of said coupled position and said decoupled position.

12. The rocker arm as in claim 11, wherein movement of said piston from said first position to said second position causes said lock member to move to said decoupled position and also causes said return spring to be compressed.

13. The rocker arm as in claim 12, wherein said return spring acting on said lock member actuation arm causes said piston to move from said second position to said first position when said lock member moves from said decoupled position to said coupled position.

14. The rocker arm as in claim 1, wherein said inner follower comprises a roller and a roller shaft such that said roller shaft supports said roller and such that said roller rotates about a roller shaft axis.

15. The rocker arm as in claim 14, wherein said roller shaft includes a central portion which is cylindrical, and centered about, said roller shaft axis such that said roller circumferentially surrounds said central portion.

16. The rocker arm as in claim 15, wherein said roller shaft also includes said inner follower first portion and said inner follower second portion.

17. The rocker arm as in claim 16, wherein at least one of said inner follower first portion and said inner follower second portion engages said lock member, thereby preventing rotation of said roller shaft about said roller shaft axis.

* * * * *